US009719722B2

(12) United States Patent
Fujitomo

(10) Patent No.: US 9,719,722 B2
(45) Date of Patent: Aug. 1, 2017

(54) GRAIN-DRYING FACILITIES

(75) Inventor: Hirota Fujitomo, Tokyo (JP)

(73) Assignee: Satake Corporation (JP)

( * ) Notice: Subject to any disclaimer, the term of this patent is extended or adjusted under 35 U.S.C. 154(b) by 508 days.

(21) Appl. No.: 14/352,051

(22) PCT Filed: Oct. 21, 2011

(86) PCT No.: PCT/JP2011/074332
§ 371 (c)(1),
(2), (4) Date: Apr. 15, 2014

(87) PCT Pub. No.: WO2013/057838
PCT Pub. Date: Apr. 25, 2013

(65) Prior Publication Data

US 2014/0250718 A1 Sep. 11, 2014

(51) Int. Cl.
*F26B 19/00* (2006.01)
*F26B 23/00* (2006.01)
(Continued)

(52) U.S. Cl.
CPC ..... *F26B 23/002* (2013.01); *F26B 17/1408* (2013.01); *F26B 23/02* (2013.01); *F26B 2200/06* (2013.01)

(58) Field of Classification Search
CPC .. F26B 2200/06; F26B 2200/08; F26B 23/02; F26B 23/022; F26B 23/026; F26B 23/028; F26B 23/10
(Continued)

(56) References Cited

U.S. PATENT DOCUMENTS 4,499,669 A * 2/1985 Haeck ..... B65G 65/365 34/102
5,443,539 A * 8/1995 Westelaken ..... F26B 17/1416 34/168
(Continued)

FOREIGN PATENT DOCUMENTS

CN 201093850 Y 7/2008
CN 101658206 A 3/2010
(Continued)

OTHER PUBLICATIONS

International Preliminary Report for PCT/JP2011/074332 dated Apr. 22, 2014.
(Continued)

*Primary Examiner* — Kenneth Rinehart
*Assistant Examiner* — John McCormack
(74) *Attorney, Agent, or Firm* — Lerner, David, Littenberg, Krumholz & Mentlik, LLP

(57) ABSTRACT

The present invention provides grain-drying facilities which can effectively use the heat energy of biomass combustion hot-air that has been generated in a biomass combustion furnace. The grain-drying facilities 1 include: a biomass combustion furnace 3 provided with a heat exchanger 24 for generating a hot air from a combustion heat of a biomass fuel and an outside air which has been taken in from the outside; and a circulation type grain-drying apparatus 2 provided with a grain-drying portion 7 to which the hot air that has been generated in the biomass combustion furnace 3 is supplied through a pipe 15 for supplying a hot air, wherein the circulation type grain-drying apparatus 2 has a plurality of warming pipes **6*a* in the grain-drying portion 7, and an exhaust hot-air is supplied to the warming pipes 6*a* from the biomass combustion furnace 3 through a pipe 11** for supplying the exhaust hot-air.

4 Claims, 9 Drawing Sheets

(51) Int. Cl.
*F26B 17/14* (2006.01)
*F26B 23/02* (2006.01)

(58) Field of Classification Search
USPC ..... 34/565, 86, 168, 182, 427; 110/238
See application file for complete search history.

(56) References Cited

U.S. PATENT DOCUMENTS

| | | | | |
|---|---|---|---|---|
| 6,318,000 | B1 * | 11/2001 | Satake | F26B 9/087 34/168 |
| 2008/0271335 | A1 * | 11/2008 | Kimball | F23G 5/0273 34/79 |

FOREIGN PATENT DOCUMENTS

| | | | |
|---|---|---|---|
| JP | S56-25678 | A | 3/1981 |
| JP | S56149543 | A | 11/1981 |
| JP | S62-190380 | A | 8/1987 |
| JP | 2000-266466 | A | 9/2000 |
| JP | 2002-71271 | A | 3/2002 |
| JP | 2002-71272 | A | 3/2002 |
| JP | 2005114238 | A | 4/2005 |
| SU | 682461 | A1 | 11/1977 |
| WO | WO-2011-132481 | A1 | 10/2011 |

OTHER PUBLICATIONS

Written Opinion for PCT/JP2011/074332 dated May 22, 2012.
Decision to Grant for Japanese Patent Application 2013-539489, dated Apr. 19, 2016.

* cited by examiner

GRAIN-DRYING FACILITIES

TECHNICAL FIELD

The present invention relates to grain-drying facilities which combust a biomass fuel such as a rice husk in a combustion furnace, and dry grains by using the hot air and the exhaust air which have been generated by the combustion.

BACKGROUND ART

Grain-drying facilities are conventionally known which combust the rice husk that is one of the biomass fuel in a combustion furnace, supply the generated hot air to a heat exchanger, warm the outside air that has been taken into the heat exchanger, generate the hot air thereby, further add an auxiliary hot-air that has been generated by a kerosene oil burner to this hot air, and supply the mixed air to a grain-drying apparatus. The temperature of the above described hot air is adjusted by mixing the hot air with the outside air, and the hot air is supplied to the grain-drying apparatus as a drying air.

CITATION LIST

Patent Literature

Japanese Patent Laid-Open No. 62-190380

SUMMARY OF INVENTION

Technical Problem

However, in the above described grain-drying facilities, the hot air (hereinafter referred to as biomass combustion hot-air) which has been generated in the combustion furnace (hereinafter referred to as biomass combustion furnace) for the combustion of the biomass is exhausted in a state of having yet included the heat energy, though a part of its heat quantity is consumed in the heat exchanger, and accordingly it is expected to effectively use the heat energy which is yet contained in the exhaust air.

Then, the present invention has been designed with respect to the above described problems, and a technological object of the present invention is to provide grain-drying facilities which can effectively use the heat energy of the biomass combustion hot-air that has been generated in the biomass combustion furnace.

This technological object has been solved as in the following way.

As is described in claim 1, grain-drying facilities of the present invention include:

a biomass combustion furnace 3 provided with a heat exchanger 24 for generating a hot air from a combustion heat of a biomass fuel and an outside air which has been taken in from the outside; and a circulation type grain-drying apparatus 2 provided with a grain-drying portion 7 to which the hot air that has been generated in the biomass combustion furnace 3 is supplied through a pipe 15 for supplying a hot air, wherein the circulation type grain-drying apparatus 2 has a plurality of warming pipes 6*a* for radiating heat from their surfaces toward the grain-drying portion 7. The grain-drying facilities employ technical means of communicating a supply side opening 6*b* in one end of the warming pipe 6*a* with a pipe 11 for supplying an exhaust hot-air discharged from the biomass combustion furnace 3, and communicating an exhaust side opening 6*c* in the other end with a suction portion by an air-exhaust fan 14, in each of the warming pipes 6*a*.

In addition, as is described in claim 2, the grain-drying facilities employ technical means of providing a warming portion 6 for warming grains there in addition to the grain-drying portion 7 in a grain-circulating tank 5, and arranging a plurality of warming pipes 6*g* in the warming portion 6.

The grains in the circulation type grain-drying apparatus 2 are preheated by heat radiated from the warming pipes 6*g* in the warming portion 6, before reaching the grain-drying portion 7, and accordingly the efficiency of grain drying is enhanced.

Furthermore, as is described in claim 3, the grain-drying facilities employ such technical means that a temperature of the exhaust hot-air passing through the inner part of the warming pipe 6*g* in the warming portion 6, and a temperature of the exhaust hot-air passing through the inner part of the warming pipe 6*a* of the grain-drying portion 7 can be individually controlled. The action of grain warming by the exhaust hot-air through the warming pipe 6*g* of the warming portion 6 and the action of the grain warming by the exhaust hot-air through the warming pipe 6*a* in a hot air body in the grain-drying portion 7 are different from each other, and accordingly each of the temperatures of the exhaust hot-airs can be rationally controlled so as to correspond to a difference between the actions.

Furthermore, as is described in claim 4, the grain-drying facilities employ technical means of arranging a plurality of warming pipes 6*a* and 6*h* in the grain-drying portion 7 and a hopper portion 8*b*, respectively.

The technical means prevents grains which have been discharged from the grain-drying portion 7 and are moving to a circulation process, from being cooled in a portion of the hopper portion 8*b*, and can suppress the lowering of the temperatures of a passing hot air (hot air passing between passing hot air body 7*a* and exhaust air body 7*b*) in the lower part of the grain-drying portion 7, due to an airflow generated when the air is sucked from the hopper portion 8*b* by the air-exhaust fan 14.

Furthermore, as is described in claim 5, the grain-drying facilities employ technical means of arranging a plurality of warming pipes 6*g* and 6*h* in the warming portion 6, the grain-drying portion 7 and the hopper portion 8*b*, respectively. The technical means makes the grains which have been preheated in the warming portion 6 be efficiently dried in the grain-drying portion 7, and even when the grains are exposed to the hopper portion 8*b* in the hopper portion 8*b* in which the grains are being circulated, or the air is sucked from the bottom part of the grain-drying portion 7 by the air-exhaust fan 18, the technical means can suppress the lowering of the temperature of the grains due to the exposure or the suction.

Furthermore, as is described in claim 6, the grain-drying facilities employ technical means of providing air volume adjustment portions 11*a* and 15*a* for adjusting the quantity of the supplied air, in the pipe 15 for supplying the hot air and the pipe 11 for supplying the exhaust hot-air.

Furthermore, as is described in claim 7, the grain-drying facilities employ technical means of providing outside air intake portions 12 and 16 for taking in the outside air, in the pipe 15 for supplying the hot air and the pipe 11 for supplying the exhaust hot-air, and providing also outside air intake quantity adjustment portions 12*a* and 16*a* in the outside air intake portions 12 and 16.

Furthermore, as is described in claim 8, the grain-drying facilities employ technical means of providing a drying portion temperature sensor 7*h* for measuring the temperature of the hot air which has been supplied, in the grain-drying portion 7, and also providing a control section 4 for driving the air volume adjustment portion 15*a* and the outside air intake quantity adjustment member 16*a* on the basis of the temperature which has been measured by the drying portion temperature sensor 7*h*, and adjusting the quantity of the supplied hot air and the quantity of the taken-in outside air.

Furthermore, as is described in claim 9, the grain-drying facilities employ technical means of providing an exhaust hot-air temperature sensor 6*f* for measuring the temperature of the supplied exhaust hot-air in the vicinity of a port 6*e* for introducing the exhaust hot-air of the pipe 11 for supplying the exhaust hot-air, and also providing a control section 4 which drives the air volume adjustment portion 11*a* and the outside air intake portion 12*a* on the basis of the temperature that has been measured by the exhaust hot-air temperature sensor 6*f*, and adjusts the quantity of the supplied exhaust hot-air and the quantity of the taken-in outside air.

Furthermore, as is described in claim 10, the grain-drying facilities employ technical means of arranging the warming pipes 6*a*, 6*g* and 6*h* so that one each end of the pipes communicates with the pipe 11 for supplying the exhaust hot-air, and arranging the air-exhaust fan in the other each end side of the pipes.

Thereby, the technical means promotes the ventilation of the exhaust hot-air in the warming pipes 6*a*, 6*g* and 6*h*, and can adjust the quantity of heat to be radiated from the warming pipes 6*a*, 6*g* and 6*h*.

Furthermore, as is described in claim 11, the grain-drying facilities employ technical means of attaching a bypass pipe line 11*b* to the pipe 11 for supplying the exhaust hot-air, which supplies the exhaust hot-air to the air-exhaust fan 14 through a flow channel switching valve 11*c*, instead of supplying the exhaust hot-air to the warming pipes 6*a*, 6*g* and 6*h* through the pipe 11.

Advantageous Effects of Invention

The grain-drying facilities of the present invention generate hot air in a heat exchanger by using a biomass combustion heat (biomass combustion hot-air) which has been generated in a biomass combustion furnace, supply the hot air as hot air for drying grains in a circulation type grain-drying apparatus, and also use a biomass combustion hot-air (exhaust air) which yet includes remaining heat energy after the biomass combustion heat has been used in the above described heat exchanger, by using a plurality of warming pipes 6*a*, 6*g* and 6*h* and making the warming pipes radiate the heat energy from the surfaces. Thereby, the grain-drying facilities can indirectly adjust the temperature of the hot air of a grain-drying portion 7 or can directly warm grains by the heat radiated from the plurality of the warming pipes 6*g* arranged in the warming portion 6 which is provided separately from the grain-drying portion 7.

As a result, the heat energy of the above described biomass combustion heat can be effectively used for drying the grains without wasting the heat energy. Besides, the above described circulation type grain-drying apparatus arranges the warming pipe 6*a* in a hot air body 7*a* of the grain-drying portion 7, facilitates the temperature of the hot air to be adjusted to a temperature suitable for tempering drying of the grains, on the basis of warming due to heat radiated from the warming pipe 6*a*, and can smoothly perform the tempering drying. In addition, the circulation type grain-drying apparatus has a grain-warming portion 6 provided in the inner part of a grain-circulating tank 5, separately from the grain-drying portion 7, makes moisture in the inner part of the grains migrate to the surface side of the grains beforehand due to a warming action of the heat radiated from the warming pipe 6*g*, accordingly shows excellent drying efficiency when drying the grains by ventilation in the grain-drying portion 7, and can shorten a drying period of time. Furthermore, the circulation type grain-drying apparatus having a structure in which the warming pipe 6*h* is arranged in a hopper portion 8*b* in the lower part warms the inner part of the hopper portion 8*b*, and accordingly can prevent the temperature of the grains which circulate in the circulation type grain-drying apparatus 1 and the temperature of passing hot air in the grain-drying portion 7 from resulting in being lowered by an airstream occurring when the air is sucked from the hopper portion 8*b*.

Furthermore, the grain-drying facilities do not use a kerosene burner or the like for generating the hot air for drying, and accordingly can dry the grains while saving energy.

DESCRIPTION OF EMBODIMENTS

Figure 1:
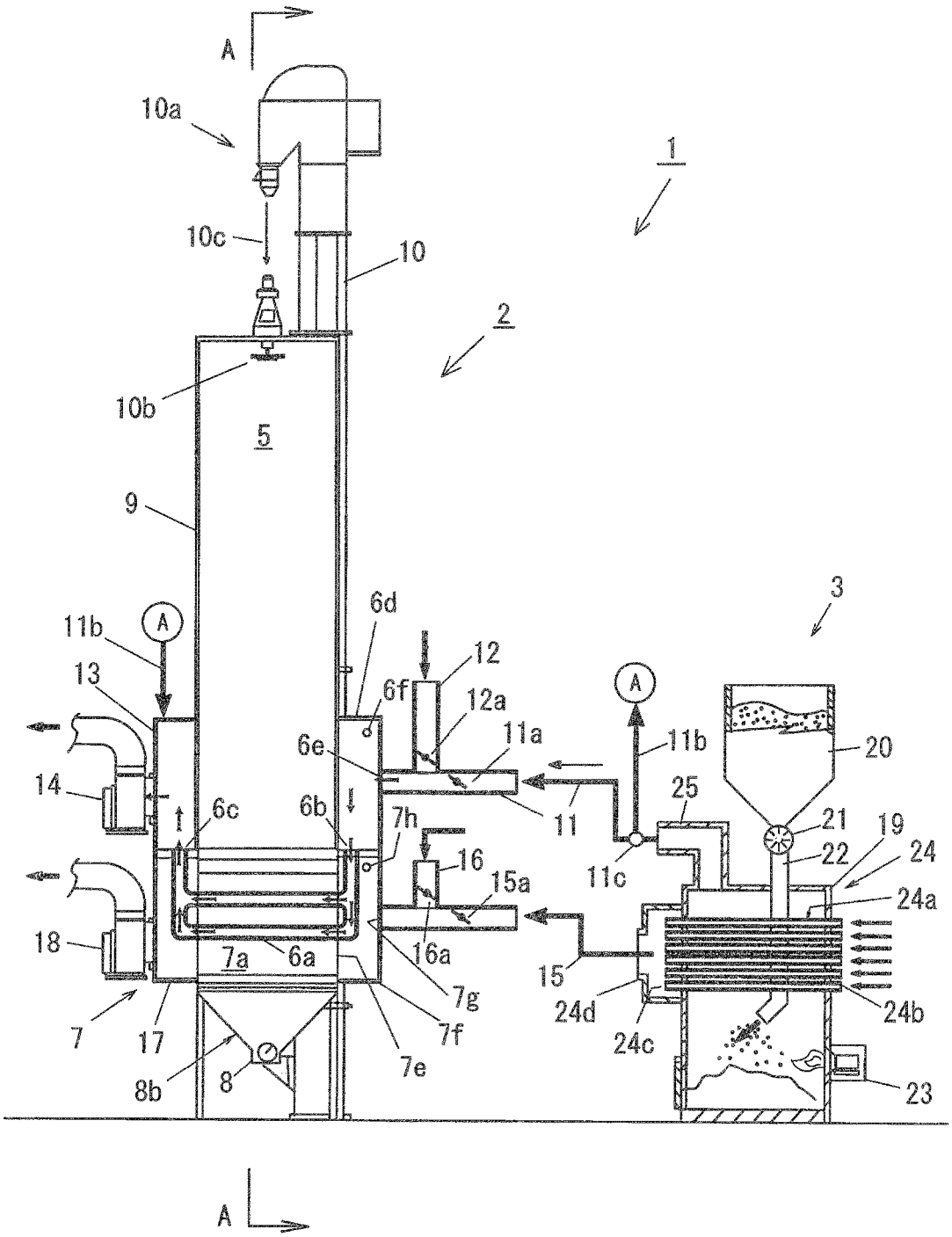
FIG. 1 is a longitudinal sectional view illustrating grain-drying facilities (Exemplary Embodiment 1) of the present invention.
Figure 2:
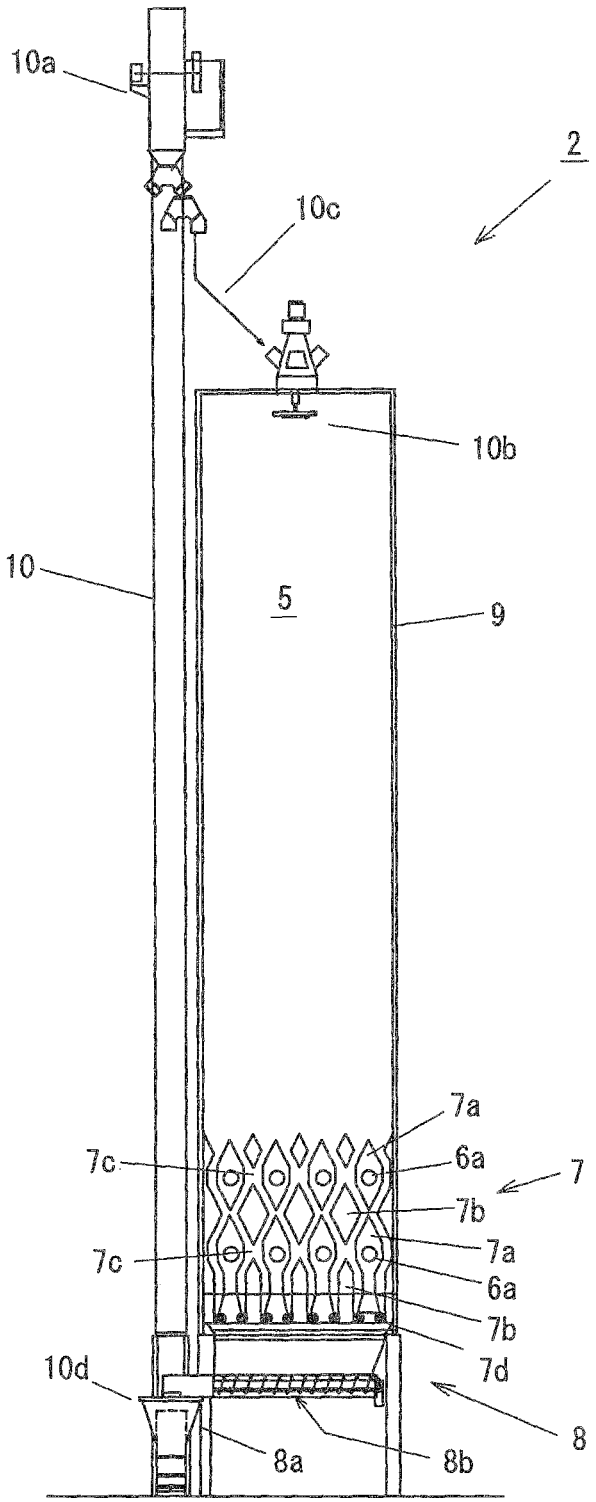
FIG. 2 is a sectional view taken along a line A-A of a circulation type grain-drying apparatus in the grain-drying facilities (Exemplary Embodiment 1) of the present invention.
Figure 7:
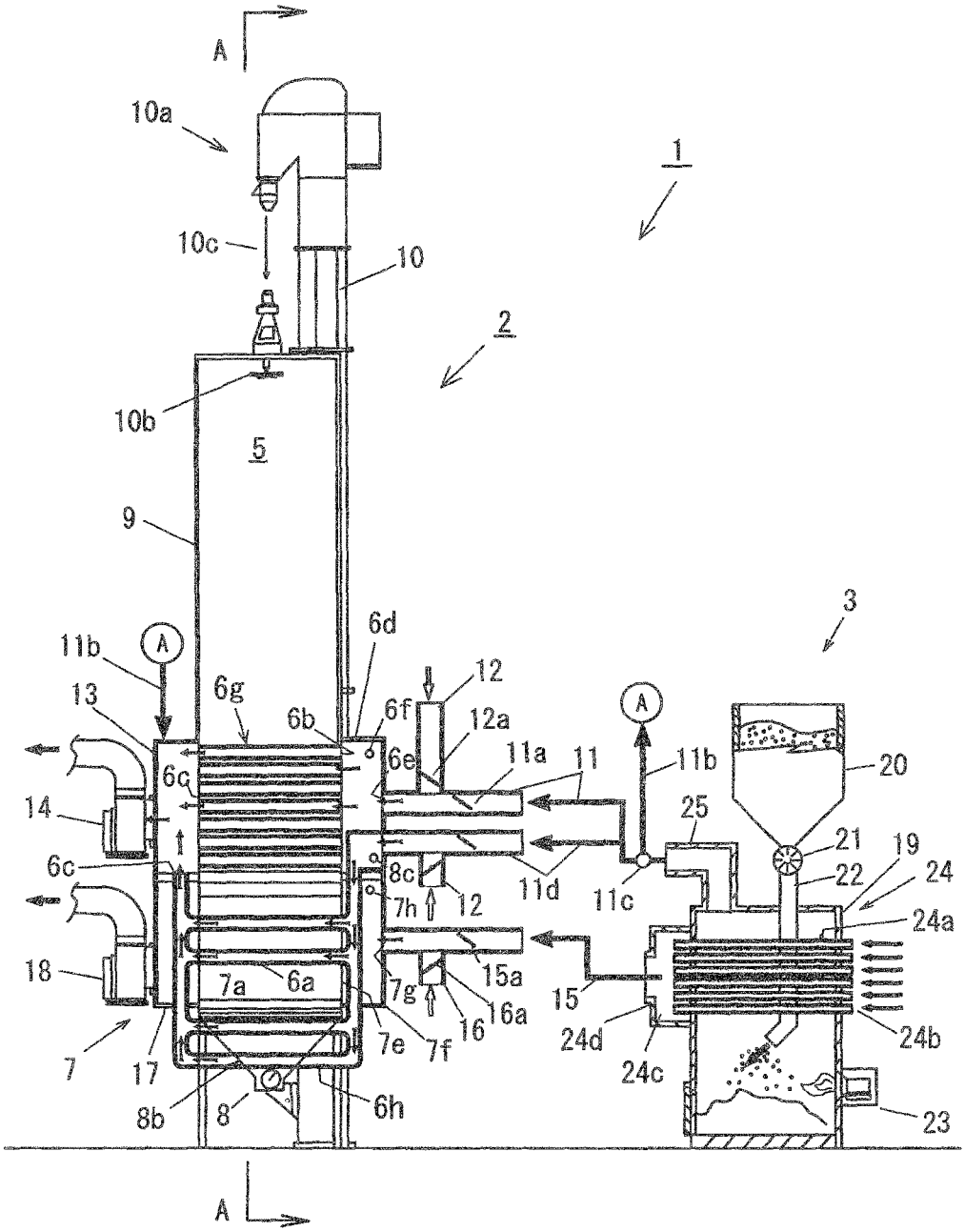
FIG. 7 is a longitudinal sectional view illustrating grain-drying facilities (Exemplary Embodiment 4) of the present invention.

Embodiments of the present invention will be described below. FIG. 1 and FIG. 2 illustrate Exemplary Embodiment 1. FIG. 1 illustrates grain-drying facilities 1 of the present invention, and the grain-drying facilities 1 include a circulation type grain-drying apparatus 2, a biomass combustion furnace 3 and a control section 4 (FIG. 7).

Circulation type grain-drying apparatus 2:

The above described circulation type grain-drying apparatus 2 has a main body portion 9 which has a grain storing/circulating tank 5, a grain-drying portion 7 (FIG. 2) and a grain-drawing portion 8 arranged so as to be sequentially stacked therein, and also an elevator 10 for returning the grains which have been discharged from the above described grain-drawing portion 8 to the grain storing/circulating tank 5. A reference numeral 6*a* denotes a warming pipe which is arranged so as to penetrate a hot air body 7*a* of the grain-drying portion 7, in this Exemplary Embodiment 1. Incidentally, the warming pipes 6*a* are conceptually illustrated for the purpose of clarifying their arrangement. The above described grain storing/circulating tank 5 has a grain supplying/scattering device 10*b* provided in the upper part. The discharge side 10*a* of the above described elevator 10 communicates with the above described grain supplying/scattering device 10*b* through a pipe line 10*c* so that the discharged grains are returned therethrough. On the other hand, the supply side 10*d* (FIG. 2) of the above described elevator 10 communicates with the discharge side 8*a* of the above described grain-drawing portion 8.

A plurality of the above described warming pipes 6*a* (8 pipes in Exemplary Embodiment 1, as in FIG. 2) are provided, and are structured so that the warming pipes 6*a* are arranged in the respective hot air bodies 7*a*, in such a horizontal state as to trend one side to the other side of the grain-drying portion 7 of the main body portion 9, and in parallel to each other in the upper and lower parts.

Both of a supply side opening 6*b* and a discharge side opening 6*c* in each of the above described warming pipes 6*a* are structured so as to be opened to the outside of the main body portion 9 (FIG. 1). A cover member 6*d* for supplying the exhaust hot-air is arranged in the above described main body portion 9 so as to surround all of the above described supply side openings 6*b*. A port 6*e* for introducing the exhaust hot-air is provided in the above described cover member 6*d* for supplying the exhaust hot-air, and a pipe line 11 (pipe for supplying exhaust hot-air) for supplying the exhaust hot-air which has been exhausted from a biomass combustion furnace 3 that will be described later is connected to the port 6*e* for introducing the exhaust hot-air. An exhaust hot-air temperature sensor 6*f* (FIG. 1) for measuring the temperature of the supplied exhaust hot-air is arranged in the inner part of the above described cover member 6*d* for supplying the exhaust hot-air and in the vicinity of the port 6*e* for introducing the exhaust hot-air of the pipe 11 for supplying the exhaust hot-air. The exhaust hot-air temperature sensor 6*f* is set so as to transmit its temperature measurement value to a control section 4 which will be described later.

An air volume adjustment damper 11*a* (air volume adjustment portion) for adjusting the air volume of the above described exhaust hot-air is provided in the inner part of the above described pipe line 11. In addition, the above described pipe line 11 has an outside air introduction pipe 12 (outside air intake portion) connected thereto at a position between a position at which the above described air volume adjustment damper 11*a* is provided and the port 6*e* for introducing the exhaust hot-air, and at the same time, the above described outside air introduction pipe 12 has an outside air intake damper 12*a* (outside air intake quantity adjustment portion) for adjusting the opening and closing of a flow channel provided in the inner part. The above described air volume adjustment damper 11*a* and the outside air intake damper 12*a* employ an automatic flow channel opening/closing damper or the like, which receives a signal sent from the control section 4 that will be described later, is automatically adjusted to be opened or closed according to the signal, and can adjust the air volume.

On the other hand, all of the discharge side openings 6*c* of each of the above described warming pipes 6*a* are structured so as to be surrounded by an air-exhaust cover 13 arranged in the above described main body portion 9. The air-exhaust fan 14 is provided at the air-exhaust cover 13.

A bypass pipe line 11*b* is provided at the above described pipe line 11. This bypass pipe line 11*b* is structured so as to communicate an arbitrary position in the above described pipe line 11 with the above described air-exhaust cover 13. This bypass pipe line 11*b* is a component for bypassing a portion of the warming pipe 6*a* to make the exhaust hot-air pass therethrough so that the exhaust hot-air in an initial period when the combustion has started in the biomass combustion furnace 3 does not pass through the above described warming pipe 6*a*. The exhaust hot-air in the initial period when the combustion has started, which has passed through the bypass pipe line 11*b*, is exhausted to the outside from the inside of the air-exhaust cover 13 by the air-exhaust fan 14. A flow channel switching damper (flow channel switching valve) 11*c* is provided at a position in the downstream side of a position to which the bypass pipe line 11*b* is connected, in the inner part of the above described pipe line 11. The flow channel switching damper 11*c* shall automatically switch the flow channel according to a signal sent from the control section 4 which will be described later.

The above described grain-drying portion 7 has a plurality of hot air bodies 7*a*, a plurality of exhaust air bodies 7*b* and a plurality of grain flowing down layers 7*c*, respectively. The above described hot air body 7*a* is structured so as to form a hollow shape by installing pairs of ventilation plates formed of a perforated iron plate or the like in an upright form at a predetermined space so as to oppose to each other. The exhaust air body 7*b* is also structured so as to form a hollow shape by installing pairs of ventilation plates formed of a perforated iron plate or the like in an upright form at a predetermined space so as to oppose to each other. The above described hot air body 7*a* and the above described exhaust air body 7*b* are alternately arranged at a predetermined space, and the grain flowing down layer 7*c* is structured so as to be located between the above described hot air body 7*a* and the above described exhaust air body 7*b*. A feed valve 7*d* for grains is provided in the lower end portion of each grain flowing down layer 7*c*.

In addition, the above described hot air body 7*a* is structured so that all of supply side openings 7*e* (FIG. 1) in one side thereof are opened to the outside of the main body portion 9. As for each of the above described supply side openings 7*e*, a cover member 7*f* for supplying the hot air (FIG. 1) is arranged on the above described main body portion 9 so as to surround all of the supply side openings 7*e*. The cover member 7*f* for supplying the hot air has a port 7*g* for introducing the hot air, and a pipe line 15 (pipe for supplying hot air) for supplying the hot air is connected thereto which has been generated in the biomass combustion furnace 3 that will be described later. A drying portion temperature sensor 7*h* for measuring the temperature of the supplied hot air is arranged in the inner part of the above described cover member 7*f* for supplying the hot air and in the vicinity of the port 7*g* for introducing the hot air. The temperature sensor 7*h* is set so as to transmit a temperature measurement value to the control section 4 which will be described later.

An air volume adjustment damper 15*a* (air volume adjustment portion) for adjusting the air volume of the above described hot air is provided in the inner part of the above described pipe line 15. In addition, the above described pipe line 15 has an outside air introduction pipe 16 (outside air intake portion) connected thereto at a position between a position at which the above described air volume adjustment damper 15*a* is provided and the port 7*g* for introducing the hot air. An outside air intake damper 16*a* (outside air intake quantity adjustment portion) for adjusting the opening and closing of the flow channel is provided in the inner part of the above described outside air introduction pipe 16. The above described air volume adjustment damper 15*a* and the outside air intake damper 16*a* employ an automatic flow channel opening/closing damper or the like, which receives a signal sent from the control section 4 that will be described later, and can automatically adjust the air volume according to the signal.

On the other hand, the discharge side opening (not-shown) which is located in the exhaust side (left side in FIG. 1) of each of the above described exhaust air bodies 7*b* (FIG. 2) is structured so as to be opened to the outside of the main body portion 9. In addition, as for the above described discharge side opening, the air-exhaust cover 17 is arranged on the above described main body portion 9 so as to surround all of the discharge side openings. An air-exhaust fan 18 is arranged so as to communicate with the internal space formed by the air-exhaust cover 17.

Biomass combustion furnace 3:

The above described biomass combustion furnace 3 has a combustion furnace 19 provided therein which combusts the biomass fuel such as a rice husk. The combustion furnace 19 has a tank portion 20 for supplying the raw material provided on its upper part, and a rotary valve 21 for supplying the raw material is provided in the discharge side of the tank portion 20 for supplying the raw material. A transport pipe 22 for transporting the biomass fuel which has been fed from the above described rotary valve 21 for supplying the raw material to the bottom part in the combustion furnace 19 is connected to the discharge side of the rotary valve 21 for supplying the raw material.

An ignition burner 23 for igniting biomass (rice husk, wood waste, fermentation cake, dried feces and the like) which has been supplied to the bottom part in the combustion furnace 19 is provided in the lower part of the above described combustion furnace 19. In addition, a heat exchanger 24 for generating hot air is provided in the upper part of the above described combustion furnace 19. The above described heat exchanger 24 is formed of a plurality of heat exchange pipes 24*a* which penetrate the upper part of the combustion furnace 19 from one side face to the other side face and are arranged in parallel with each other. In each of the heat exchange pipes 24*a*, an outside air suction port 24*b* is provided in one side, and a hot air discharge port 24*c* is provided in the other side. As for the hot air discharge port 24*c*, a hot air discharge cover member 24*d* is arranged on the above described combustion furnace 19 so as to surround all of the hot air discharge ports 24*c*. The hot air discharge cover member 24*d* communicates with the above described pipe line 15.

The above described combustion furnace 19 has an exhaust pipe 25 for discharging the exhaust hot-air (biomass combustion hot-air) after the biomass combustion hot-air which has been generated by the combustion of the biomass fuel has been used for the heat exchanger 24 provided in its upper part, and the exhaust pipe 25 is communicated with the above described pipe line 11.

The above described structure of the biomass combustion furnace 3 is one example, and should not limit the present invention.

Control section 4:

The above described control section 4 is connected to each of the above described exhaust hot-air temperature sensor 6*f*, the drying portion temperature sensor 7*h*, the air passage adjustment dampers 11*a* and 15*a*, the outside air intake dampers 12*a* and 16*a*, the rotary valve 21 for supplying the raw material and the ignition burner 23, and controls the air passage adjustment dampers 11*a* and 15*a*, the outside air intake dampers 12*a* and 16*a*, and the rotary valve 21 for supplying the raw material, on the basis of the measurement temperature sent from the above described warming portion temperature sensor 6*f* and the drying portion temperature sensor 7*h*.

Action:

The action of the above described grain-drying facilities 1 will be described below.

Firstly, the above described biomass combustion furnace 3 starts the combustion. When the above described biomass combustion furnace 3 starts the combustion, the above described rotary valve 21 for supplying the raw material starts driving on the basis of the signal sent from the above described control section 4, and the above described tank portion 20 for supplying the raw material supplies the biomass fuel (rice husk and the like) to the inside of the combustion furnace 19. On the other hand, the above described ignition burner 23 starts driving, ignites the above described biomass fuel and starts the combustion, and thereby the combustion furnace 3 produces the biomass combustion hot-air. Incidentally, the above described ignition burner 23 stops the ignition after the biomass fuel has ignited.

On the other hand, the above described circulation type grain-drying apparatus 2 also starts driving according to the signal to start driving, which has been sent from the above described control section 4. (Incidentally, here, it is assumed that a filling operation of charging grains into grain storing/circulating tank 5, and making the grains be in a state to be dried has been already completed). Thereby, in the above described circulation type grain-drying apparatus 2, each of the above described air-exhaust fans 14 and 18, the elevator 10, the feed valve 7*d*, the grain supplying/scattering device 10*b* and the grain-drawing portion 8 starts driving.

In the above described biomass combustion furnace 3, when the biomass fuel is a rice husk, the exhaust hot-air (biomass combustion hot-air) which is discharged from the above described exhaust pipe 25 in an initial period after the combustion has been started contains much oil such as tar. Accordingly, in order to avoid the exhaust hot-air, the flow channel is switched to the bypass pipe line 11*b* by the above described flow channel switching damper 11*c* only for a predetermined period of time, and the exhaust hot-air is exhausted through the bypass pipe line 11*b* to the outside by the air-exhaust fan 14. Thereby, the above described initial exhaust hot-air is not supplied to the above described grain warming portion 6, and does not exert a bad influence on the grain quality, by any chance. Thus, the safety is considered.

The above described heat exchanger 24 sucks the outside air to the inside of heat exchange pipes 24*a* by the sucking action of the above described air-exhaust fan 18, receives a combustion heat of the hot air due to the biomass combustion of the rice husk, and generates hot air. The hot air which has been generated in the above described heat exchanger 24 is supplied to the grain-drying portion 7 through a hot air discharge cover 24*d*, a pipe line 15 and a cover member 7*f* for supplying the hot air. The hot air which has been supplied to the grain-drying portion 7 entered into each of the above described hot air bodies 7*b* (FIG. 2), then passes between the grains in the grain flowing down layer 7*c*, enters into the exhaust air body 7*b*, then passes through the inner part of the above described air-exhaust cover 17, and is exhausted from the air-exhaust fan 18. The grains in the above described grain storing/circulating tank 5 receive a ventilation action of the hot air due to the driving of the above described feed valve 7*d* when sequentially flowing down through the grain flowing down layer 7*c*, and then are returned to the grain storing/circulating tank 5 through the elevator 10 or the like.

On the other hand, when the predetermined period of time (for instance, 30 minutes) has passed after the combustion has started in the above described biomass combustion furnace 3, the flow channel is switched by driving the above described flow channel switching damper 11*c*, in order to stop the exhaust of the above described exhaust hot-air to the outside through the bypass pipe line 11*b* and supply the exhaust hot-air to the above described grain warming portion 6. Then, the above described exhaust hot-air passes through the inside of each of the warming pipes 6*a* through the above described pipe line 11 and the cover member 6*d* for supplying the exhaust hot-air, warms each of the warming pipes 6*a*, then passes through the inner part of the air-exhaust cover 13, and is exhausted from the air-exhaust fan 14.

The grains are dried by the action of the hot air which passes between the above described hot air body 7*a* and the exhaust air body 7*b*, in the grain-drying portion 7. In other words, the grains receive the ventilation action of the hot air and the moisture is removed, when the grains flow down through the grain flowing down layer 7*c* in the above described grain-drying portion 7.

The temperature of the hot air passing through the hot air body 7*a* is adjusted by adjusting the temperature of the hot air itself, on the basis of a warming action due to heat radiated from the warming pipe 6*a* which penetrates the inner part of the hot air body. In other words, the temperature of the exhaust hot-air passing through the inside of the warming pipe 6*a* is kept almost constant, and thereby the exhaust hot-air indirectly acts on the temperature in the hot air body. On the other hand, the hot air directly acts on the temperature in the hot air body to adjust the temperature in the hot air body. The hot air which passes between the hot air body 7*a* and the exhaust air body 7*b* to dry the grains has a temperature which has been adjusted in this way.

In addition, the heat radiated from the warming pipe 6*a* has also an effect of warming the grains flowing down through the grain flowing down layer 7*c*.

The above described control section 4 controls the temperature adjustment for the temperature of the exhaust hot-air to be supplied to the above described warming pipe 6*a*, and the temperature of the hot air to be supplied to the grain-drying portion 7. The above described control section 4 adjusts and controls the temperature of the exhaust hot-air to be supplied to the warming pipe 6*a*, by outputting a drive signal to the air passage adjustment damper 11*a* and the outside air intake damper 12*a* so that the detected temperature is controlled within a predetermined temperature range (for instance, 60° C. to 80° C.) which has been previously determined, on the basis of the detected temperature of the above described exhaust hot-air temperature sensor 6*f*, and making the dampers change the quantity of the opening/closing. The above described control section 4 also adjusts and controls the temperature of the hot air to be supplied to the grain-drying portion 7 in a similar way to the above description, by outputting a drive signal to the air passage adjustment damper 15*a* and the outside air intake damper 16*a* so that the detected temperature is controlled within a predetermined temperature range (for instance, 43° C. to 50° C.) which has been previously determined, on the basis of the detected temperature of the above described drying portion temperature sensor 7*h*, and making the dampers change the quantity of the opening/closing.

The temperature in the hot air body 7*a* of the drying portion 7 is controlled so as to be within a range of 43° C. to 50° C. The temperature in the hot air body 7*a* is directly affected by a temperature of the hot air, but the temperature of the hot air occasionally is lowered in a passing process, and accordingly the warming effect due to the exhaust hot-air in the warming pipe 6*a* is used as described above, in order to suppress the lowering of the temperature and keep the temperature almost constant. The temperature of the exhaust hot-air passing through the warming pipe 6*a* is adjusted so as to be within a range of 60° C. to 80° C., and the temperature in the hot air body 7*a* in the drying portion 7 is indirectly kept within the above described range (43° C. to 50° C.)

In addition, when the temperature cannot be sufficiently controlled only by the temperature adjustment due to the hot air, the temperature of the exhaust hot-air passing through the inside of the above described warming pipe 6*a* is occasionally adjusted.

Furthermore, when the above described temperature of the exhaust hot-air and the temperature of the hot air do not enter the above described predetermined temperature range, even by having changed the quantity of the opening/closing of the air passage adjustment dampers 11*a* and 15*a* and the outside air intake dampers 12*a* and 16*a* in the above described way, the above described control section 4 changes the combustion quantity itself of the rice husk by stopping the driving of the rotary valve 21 for supplying the raw material of the above described biomass combustion furnace 3 or changing the rotation speed.

As described above, the grain-drying facilities 1 of the present invention use the combustion heat of the biomass fuel such as the rice husk, use the hot air which has been generated in the heat exchanger 24, and also use the heat energy remaining after having been used in the above described heat exchanger 24 as the exhaust hot-air in the above described circulation type grain-drying apparatus; and accordingly can effectively use the above described heat energy and also show the excellent efficiency of drying of the grains. In addition, the grain-drying facilities do not use a kerosene burner or the like for generating the hot air for drying, and accordingly can dry the grains while saving energy.

Figure 3:
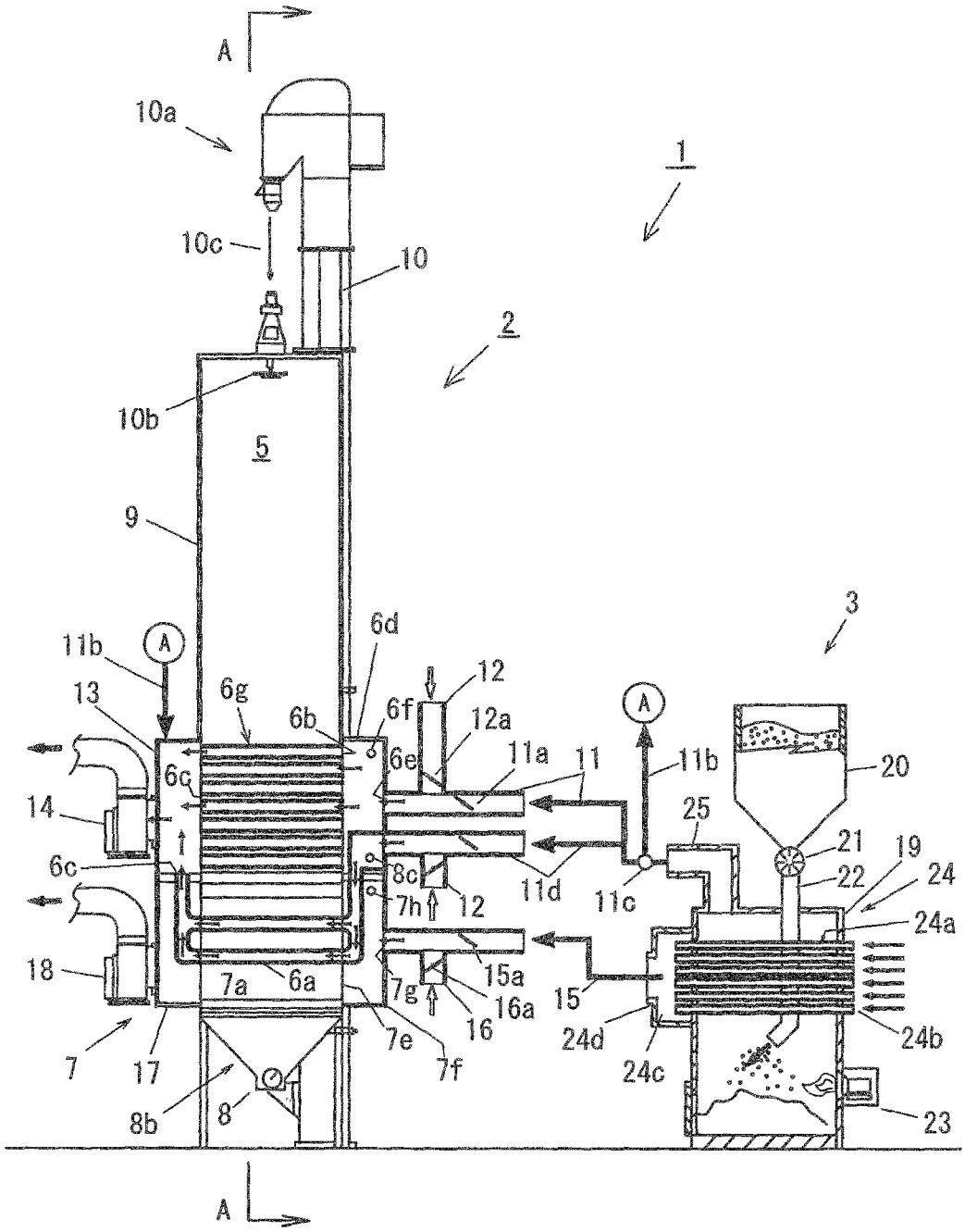
FIG. 3 is a longitudinal sectional view illustrating grain-drying facilities (Exemplary Embodiment 2) of the present invention.
Figure 4:
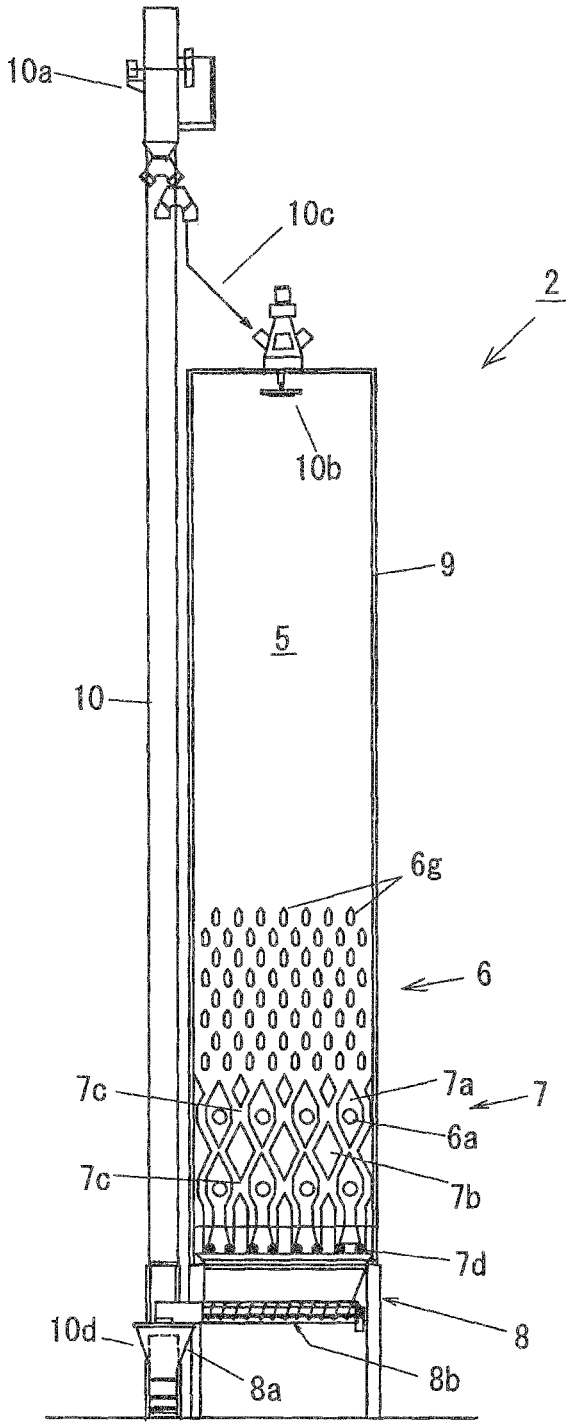
FIG. 4 is a sectional view taken along the line A-A of a circulation type grain-drying apparatus in the grain-drying facilities (Exemplary Embodiment 2) of the present invention.

FIGS. 3 and 4 illustrate Exemplary Embodiment 2. Incidentally, warming pipes 6*a* in the grain-drying portion 7 are conceptually illustrated for the purpose of illustrating their arrangement. The point at which the present exemplary embodiment is different from Exemplary Embodiment 1 is that the present exemplary embodiment has a warming portion 6 provided in the inner part (in lower part close to grain-drying portion 7 in Exemplary Embodiment 2) of the grain storing/circulating tank 5. The description about the same structure and action as those in Exemplary Embodiment 1 will be omitted.

A plurality of warming pipes 6*g* (FIG. 4) are structured to be arranged in the warming portion 6 in such a horizontal state as to traverse the main body portion 9 from one side to the other side, in parallel to each other, and in a staggered state in upper and lower directions (in state in which positions of warming pipes 6*g* in upper row and positions of warming pipes 6*g* in lower row do not overlap each other in upper and lower directions). The warming pipe 6*g* is formed to have such a shape in the longitudinal cross section of the main body portion that the right and left faces in the upper part have downwardly tilting shapes, so as to enhance the flowing down action of the grains.

Both of a supply side opening 6*b* and a discharge side opening 6*c* in each of the above described warming pipes 6*g* are structured so as to be opened to the outside of the main body portion 9 (FIG. 3). A cover member 6*d* for supplying the exhaust hot-air is arranged in the above described main body portion 9 so as to surround all of the above described supply side openings 6*b*. A port 6*e* for introducing the exhaust hot-air is provided in the above described cover member 6*d* for supplying the exhaust hot-air, and a pipe line 11 (pipe for supplying exhaust hot-air) for supplying the exhaust hot-air which has been exhausted from a biomass combustion furnace 3 that will be described later is connected to the port 6*e* for introducing the exhaust hot-air. An exhaust hot-air temperature sensor 6*f* (FIG. 1) for measuring the temperature of the supplied exhaust hot-air is arranged in the inner part of the above described cover member 6*d* for supplying the exhaust hot-air. The warming portion temperature sensor 6*f* is set so as to transmit its temperature measurement value to a control section 4 (FIG. 7) similar to the above described one.

A plurality of warming pipes 6*a* are arranged also in the grain-drying portion 7. In this Exemplary Embodiment 2, the exhaust hot-air is supplied to these warming pipes 6*a* from a second pipe line 11*d* which is branched from the pipe line 11. An air volume adjustment damper 11*a*, an outside air introduction pipe 12 and an outside air intake damper 12*a* are provided between the second pipe line 11*d* and the supply side opening 6*b* of the warming pipes 6*a*, in a similar way to the case of the pipe line 11 to the grain-drying portion 7. In addition, though not being illustrated in the figure, a hopper portion temperature sensor 8*c* similar to the above description is arranged in the vicinity of the supply side opening 6*b* of the warming pipes 6*a* associated with the above described second pipe line 11*d*, and is connected to the control section 4. Thereby, a temperature of the exhaust hot-air passing through the inner part of the warming pipes 6*g* in the warming portion 6 and a temperature of the exhaust hot-air passing through the inner part of the warming pipes 6*a* in the grain-drying portion 7 can be individually controlled.

The discharge side opening 6*c* of the warming pipe 6*a* in the grain-drying portion 7 is opened to a space (space surrounded by air-exhaust cover 13) which is common with the discharge side opening 6*c* in the warming portion 6. The temperature of the warming portion 6 is also controlled in a similar way to the warming action in the grain-drying portion 7. The temperature of the exhaust hot-air passing through the warming pipe 6*a* in the grain-drying portion 7 is ordinarily 60° C. to 80° C., and the temperature of the exhaust hot-air passing through the warming pipe 6*g* in the warming portion 6 is ordinarily set at 80° C. to 120° C.

Incidentally, in this Exemplary Embodiment 2, the supply side opening 6*b* of the warming pipe 6*g* in the warming portion 6 is opened to a space surrounded by the cover member 6*d* for supplying the exhaust hot-air, and the discharge side opening 6*c* is opened to a space surrounded by the air-exhaust cover 13.

The mechanism that the hot air is supplied to and discharged from the hot air body 7*a* in the grain-drying portion 7 and the mechanism that the exhaust hot-air is supplied to and discharged from the warming pipes 6*a* and 6*g* in the grain-drying portion 7 and the warming portion 6 are the same as the case in Exemplary Embodiment 1.

The exhaust hot-air is occasionally supplied to and discharged from the warming pipe 6*g* in the warming portion 6 and the warming pipe 6*a* in the grain-drying portion 7 through common flow channels, respectively.

In Exemplary Embodiment 2, the warming portion 6 provided with a large number of the warming pipes 6*g* is provided in the upstream side of the grain-drying portion 7 in addition to the grain-drying portion 7, accordingly the grains are preheated before reaching the grain-drying portion 7 and are surely uniformly preheated, and the drying efficiency is more enhanced.

The temperature of the hot air in the hot air body in the grain-drying portion 7 is adjusted by the hot air, on the basis of warming due to the exhaust hot-air passing through the warming pipe 6*a*, and accordingly is easily kept constant.

Figure 5:
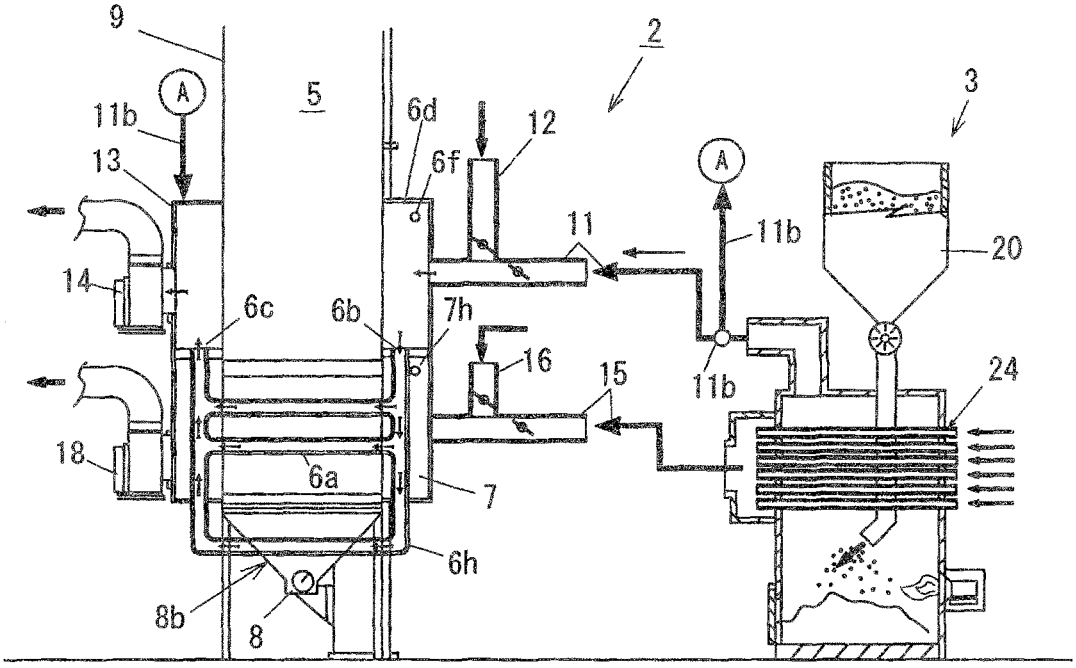
FIG. 5 is a longitudinal sectional view illustrating grain-drying facilities (Exemplary Embodiment 3) of the present invention.
Figure 6:
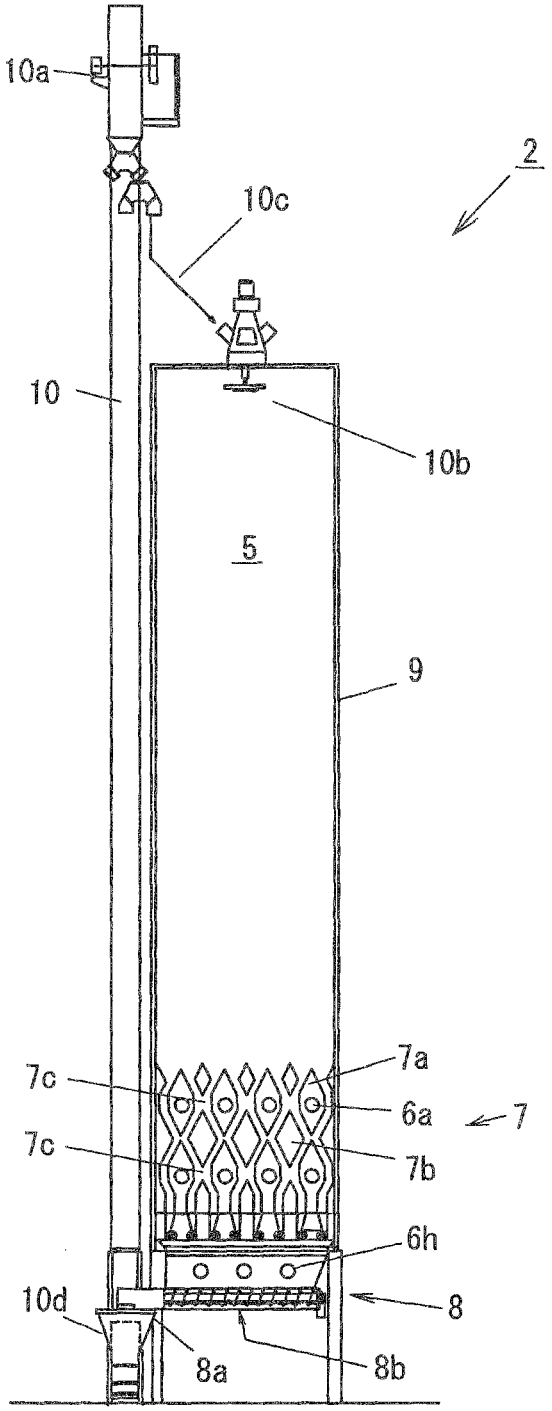
FIG. 6 is a sectional view taken along the line A-A of a circulation type grain-drying apparatus of the grain-drying facilities (Exemplary Embodiment 3) of the present invention.

FIGS. 5 and 6 illustrate Exemplary Embodiment 3, and in FIG. 5, a circulation type grain-drying apparatus 2 is illustrated in such a form that the upper part is omitted. In addition, warming pipes 6*a* and 6*h* are conceptually illustrated for the purpose of illustrating their arrangement.

The point at which Exemplary Embodiment 3 is different from Exemplary Embodiment 1 is that a warming pipe 6*h* is provided also in a hopper portion 8*b* in addition to a grain-drying portion 7. The warming pipe 6*h* may be arranged so as to penetrate the hopper portion 8*b* or may be arranged only in the inner part so as not to be exposed to the outside from the hopper portion 8*b*. In any case, a supply side opening 6*b* of a plurality of warming pipes 6*h* in the hopper portion 8*b* is opened to a space surrounded by an cover member 6*d* for supplying the exhaust hot-air commonly with the warming pipes 6*a* in the grain-drying portion 7, and a discharge side opening 6*c* is opened to a space surrounded by an air-exhaust cover 13 commonly with the warming pipes 6*a* in the grain-drying portion 7. In Exemplary Embodiment 3, the warming pipes 6*h* in the hopper portion 8*b* and the warming pipes 6*a* in the grain-drying portion 7 are connected to each other in the supply side and the discharge side, respectively, and the supply side opening 6*b* and the discharge side opening 6*c* are structured to be common.

The exhaust hot-air may be supplied to and discharged from the warming pipe 6*h* in the hopper portion 8*b* and the warming pipe 6*a* in the grain-drying portion 7, through respectively different flow channels from each other.

The other structures and the mechanism of the supply and discharge of the exhaust hot-air are the same as in Exemplary Embodiment 1, and the description will be omitted.

In Exemplary Embodiment 3, the warming pipe 6*h* is arranged also in the hopper portion 8*b* of the lower part of the grain-drying portion 7, in addition to the grain-drying portion 7, and accordingly the inner part of the hopper portion 8 is warmed. A temperature of the exhaust hot-air passing through the warming pipe 6*h* in the hopper portion 8*b* is ordinarily set at 60° C. to 80° C., which is the same temperature as the temperature of the exhaust hot-air passing through the warming pipe 6*a* in the grain-drying portion 7. The hopper portion 8*b* is a portion at which the grains having been placed in an almost sealed environment such as the grain storing/circulating tank 5 to the grain-drying portion 7 are released to an internal space of the hopper portion 8*b*, and the temperature of the grains is easily lowered while the grains move from a grain-drawing portion 8 to an elevator 10, but the lowering of the temperature of the grains can be suppressed by the warming pipes 6*h* arranged there.

In addition, there is anxiety that an airstream is generated by the sucking action of the air-exhaust fan 18, which flows to the grain-drying portion 7 from the hopper portion 8 and to the grain layer through a feed valve 7*d*, and the temperature of passing hot air in the lower part of the grain layer results in being lowered, but the lowering of the temperature of the passing hot air due to the above described airstream can be suppressed by the warming action for the inner part of the hopper portion 8*b*.

Figure 8:
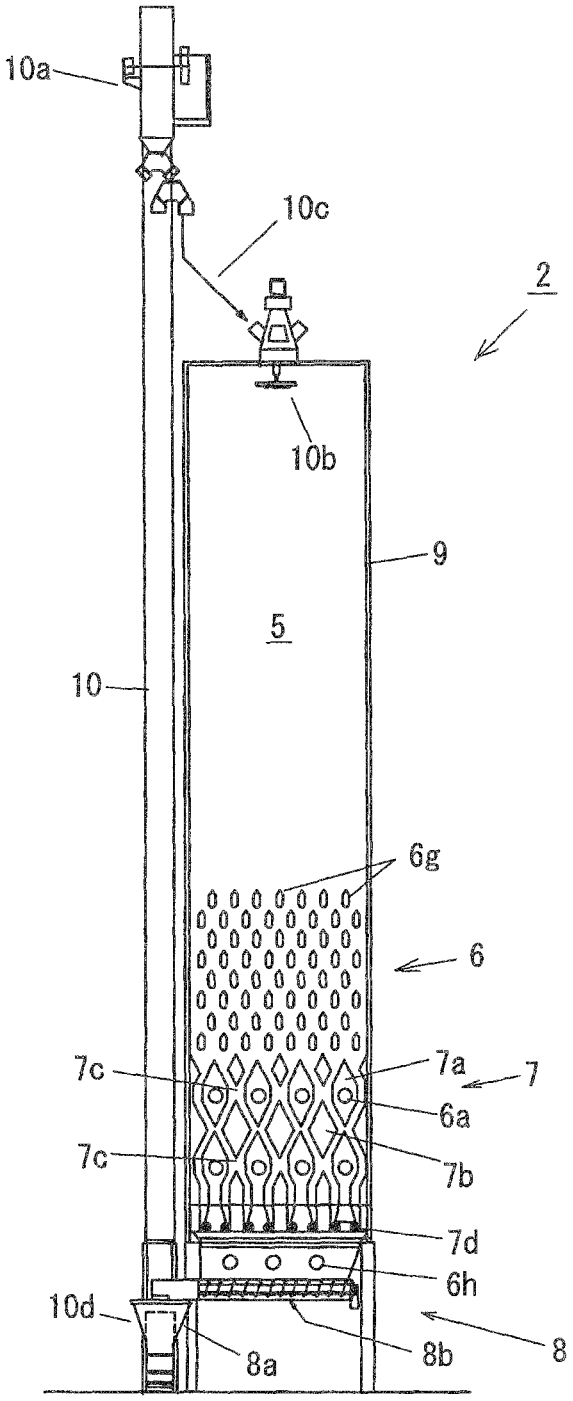
FIG. 8 is a sectional view taken along the line A-A of a circulation type grain-drying apparatus in the grain-drying facilities (Exemplary Embodiment 4) of the present invention.
Figure 9:
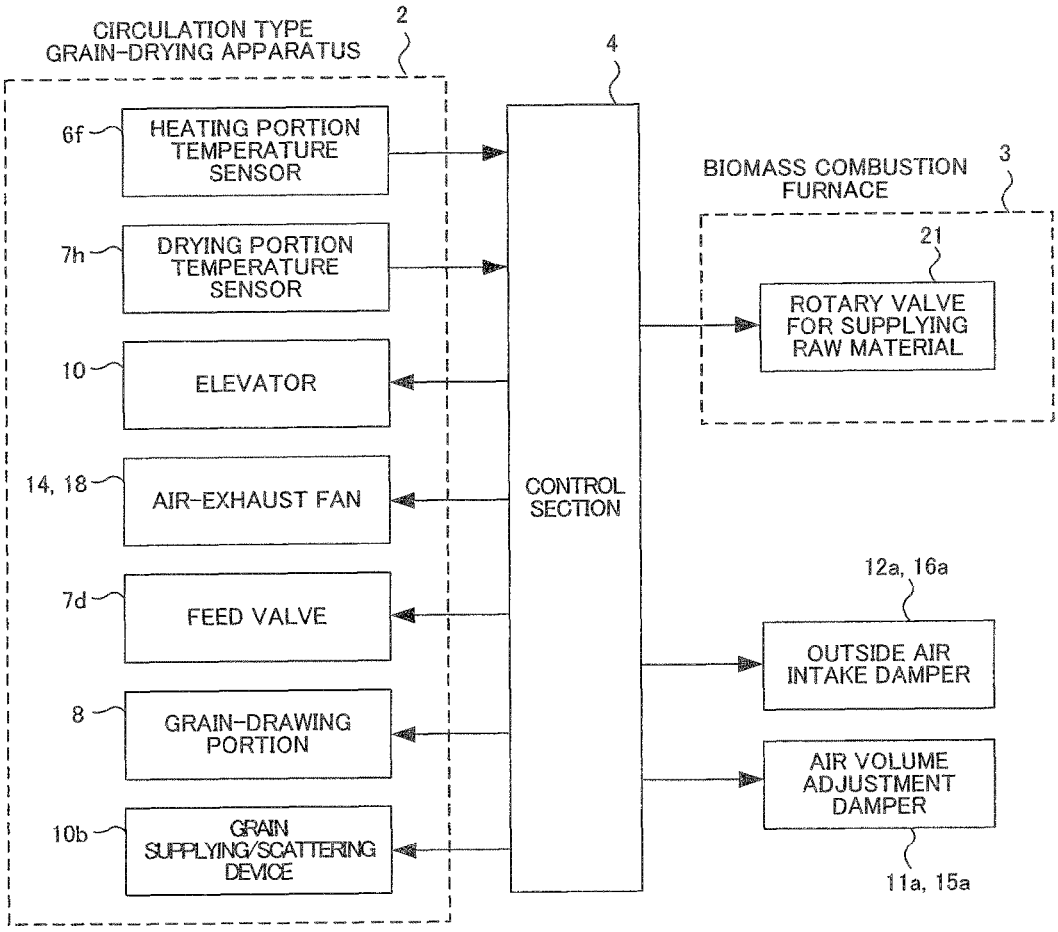
FIG. 9 is a block diagram of control in grain-drying facilities of the present invention.

FIGS. 7 and 8 illustrate Exemplary Embodiment 4. Warming pipes 6*a*, 6*g* and 6*h* are conceptually illustrated for the purpose of illustrating their arrangement. In Exemplary Embodiment 4, warming pipes 6*a*, 6*g* and 6*h* are arranged in a warming portion 6, a grain-drying portion 7 and a hopper portion 8*b*, respectively in a circulation type grain-drying apparatus 2. The structure corresponds to a structure in which the warming portion 6 is added to the above described structure of Exemplary Embodiment 3. The structures and the functions of the warming pipes 6*a*, 6*g* and 6*h* are the same as have been described in the above described Exemplary Embodiments 1 to 3, but this structure has the warming pipes 6*a*, 6*g* and 6*h* arranged respectively in the warming portion 6, the grain-drying portion 7 and the hopper portion 8*b*, and thereby can perform an adequate tempering action while preventing the lowering of the temperature of the grains by a whole of the circulation type grain-drying apparatus 2.

The four exemplary embodiments have been described above, but this invention is not limited to the specific structures in the exemplary embodiments.

The numbers and cross-sectional shapes of the warming pipes 6*a*, 6*g* and 6*h* arranged in each portion, and the structures of flow channels for supplying and exhausting the exhaust hot-air therethrough to and from the warming pipes 6*a*, 6*g* and 6*h* can be variously designed.

INDUSTRIAL APPLICABILITY

The present invention is effective as grain-drying facilities which effectively use the combustion heat of a biomass fuel such as a rice husk, and at the same time, can efficiently dry grains while saving energy.

LIST OF REFERENCE SIGNS

1 Grain-drying facilities
2 Circulation type grain-drying apparatus
3 Biomass combustion furnace
4 Control section
5 Grain storing/circulating tank
6 Grain-warming portion
6*a* Warming pipe (grain-drying portion)
6*b* Supply side opening
6*c* Discharge side opening
6*d* Cover member for supplying exhaust hot-air
6*e* Port for introducing exhaust hot-air
6*f* Warming portion temperature sensor
6*g* Warming pipe (warming portion)
6*h* Warming pipe (hopper portion)
7 Grain-drying portion
7*a* Hot air body
7*b* Exhaust air body
7*c* Grain flowing down layer
7*d* Feed valve
7*e* Supply side opening
7*f* Cover member for supplying hot air
7*g* Port for introducing hot air
7*h* Drying portion temperature sensor
8 Grain-drawing portion
8*a* Discharge side
8*b* Hopper portion
8*c* Hopper portion temperature sensor
9 Main body portion
10 Elevator
10*a* Discharge side
10*b* Grain supplying/scattering device
10*c* Pipe line
10*d* Supply side
11 Pipe line (pipe for supplying exhaust hot-air)
11*a* Air volume adjustment damper (air volume adjustment portion)
11*b* Bypass pipe line
11*c* Flow channel switching damper (flow channel switching valve)
11*d* Second pipe line (pipe for supplying exhaust hot-air)
12 Outside air introduction pipe (outside air intake portion)
12*a* Outside air intake damper (outside air intake quantity adjustment portion)
13 Air-exhaust cover
14 Air-exhaust fan
15 Pipe line (pipe for supplying hot air)
15*a* Air volume adjustment damper (air volume adjustment portion)
16 Outside air introduction pipe (outside air intake portion)
16*a* Outside air intake damper (outside air intake quantity adjustment portion)
17 Air-exhaust cover
18 Air-exhaust fan
19 Combustion furnace
20 Tank portion for supplying raw material
21 Rotary valve for supplying raw material
22 Transport pipe
23 Ignition burner
24 Heat exchanger
24*a* Heat exchange pipe
24*b* Outside air suction port
24*c* Hot air discharge port
24*d* Hot air discharge cover member
25 Exhaust pipe

The invention claimed is:

1. Grain-drying facilities comprising:

a biomass combustion furnace; and a circulation type grain-drying apparatus, wherein the biomass combustion furnace is provided with a heat exchanger which warms an outside air that has been taken in from the outside by the combustion heat of a biomass fuel, and generates hot air, and with an exhaust pipe; and the circulation type grain-drying apparatus is provided with a main body and an elevator, wherein the main body has a grain-circulating tank, a grain-drying portion provided with a plurality of hollow-shaped hot air bodies that are formed of a perforated iron plate, and a lower hopper portion disposed at a bottom of the main body and having a grain-drawing portion, which are arranged so as to be sequentially stacked from the upper side to the lower side, wherein the grain-drying portion is a portion to which the hot air that has been generated in the heat exchanger of the biomass combustion furnace is supplied through a pipe for supplying a hot air, in which the hot air passes among grains, and from which the hot air is discharged outside; and a warming pipe is arranged so as to penetrate each of the plurality of the hot air bodies of the grain-drying portion, an exhaust hot-air is introduced into the warming pipe from the exhaust pipe of the biomass combustion furnace through a pipe for supplying the exhaust hot-air, and an exhaust port of the warming pipe is opened to the outside of the circulation type grain-drying apparatus, further comprising air volume adjustment portions for adjusting the quantity of a supplied air provided in the pipe for supplying the hot air and the pipe for supplying the exhaust hot-air, respectively.

2. Grain-drying facilities comprising:

a biomass combustion furnace; and a circulation type grain-drying apparatus, wherein the biomass combustion furnace is provided with a heat exchanger which warms an outside air that has been taken in from the outside by the combustion heat of a biomass fuel, and generates hot air, and with an exhaust pipe, and the circulation type grain-drying apparatus is provided with a main body and an elevator, wherein the main body has a grain-circulating tank, a grain-drying portion provided with a plurality of hollow-shaped hot air bodies that are formed of a perforated iron plate, and a lower hopper portion disposed at a bottom of the main body and having a grain-drawing portion, which are arranged so as to be sequentially stacked from the upper side to the lower side, wherein the grain-drying portion is a portion to which the hot air that has been generated in the heat exchanger of the biomass combustion furnace is supplied through a pipe for supplying a hot air, in which the hot air passes among grains, and from which the hot air is discharged outside; and a warming pipe is arranged so as to penetrate each of the plurality of the hot air bodies of the grain-drying portion, an exhaust hot-air is introduced into the warming pipe from the exhaust pipe of the biomass combustion furnace through a pipe for supplying the exhaust hot-air, and an exhaust port of the warming pipe is opened to the outside of the circulation type grain-drying apparatus, further comprising air volume adjustment portions for adjusting the quantity of a supplied air provided in the pipe for supplying the hot air and the pipe for supplying the exhaust hot-air, respectively, further comprising outside air intake portions for taking in an outside air provided in the pipe for supplying the hot air and the pipe for supplying the exhaust hot-air respectively, wherein the outside air intake portions have outside air intake quantity adjustment portions provided therein.

3. Grain-drying facilities comprising:

a biomass combustion furnace; and a circulation type grain-drying apparatus, wherein the biomass combustion furnace is provided with a heat exchanger which warms an outside air that has been taken in from the outside by the combustion heat of a biomass fuel, and generates hot air, and with an exhaust pipe, and the circulation type grain-drying apparatus is provided with a main body and an elevator, wherein the main body has a grain-circulating tank, a grain-drying portion provided with a plurality of hollow-shaped hot air bodies that are formed of a perforated iron plate, and a lower hopper portion disposed at a bottom of the main body and having a grain-drawing portion, which are arranged so as to be sequentially stacked from the upper side to the lower side, wherein the grain-drying portion is a portion to which the hot air that has been generated in the heat exchanger of the biomass combustion furnace is supplied through a pipe for supplying a hot air, in which the hot air passes among grains, and from which the hot air is discharged outside; and a warming pipe is arranged so as to penetrate each of the plurality of the hot air bodies of the grain-drying portion, an exhaust hot-air is introduced into the warming pipe from the exhaust pipe of the biomass combustion furnace through a pipe for supplying the exhaust hot-air, and an exhaust port of the warming pipe is opened to the outside of the circulation type grain-drying apparatus, further comprising air volume adjustment portions for adjusting the quantity of a supplied air provided in the pipe for supplying the hot air and the pipe for supplying the exhaust hot-air, respectively, further comprising outside air intake portions for taking in an outside air provided in the pipe for supplying the hot air and the pipe for supplying the exhaust hot-air respectively, wherein the outside air intake portions have outside air intake quantity adjustment portions provided therein, further comprising: a drying portion temperature sensor which measures the temperature of the hot air that has been supplied to the drying portion provided in the grain-drying portion; and a control section provided therein which drives the air volume adjustment portion and the outside air intake quantity adjustment portion, on the basis of the temperature that has been measured by the drying portion temperature sensor, and adjusts the quantity of the supplied hot air and the quantity of the taken-in outside air.

4. The grain-drying facilities according to claim 2, further comprising:

an exhaust hot-air temperature sensor for measuring the temperature of the supplied exhaust hot-air arranged in the vicinity of a supply side opening of the warming pipe.

* * * * *